United States Patent [19]

Mori et al.

[11] 3,962,786

[45] June 15, 1976

[54] APPARATUS FOR CUTTING RIVETS OF TENSIONED REINFORCEMENT IN THE PROCESS OF MANUFACTURING CONCRETE PRODUCTS

[75] Inventors: Takemitsu Mori, Hachioji; Katsunori Miyata, Hoya, both of Japan

[73] Assignee: Nippon Concrete Industries Co. Ltd., Tokyo, Japan

[22] Filed: Dec. 30, 1974

[21] Appl. No.: 537,369

[52] U.S. Cl. ..... 30/168; 30/106; 29/200 D; 140/107

[51] Int. Cl.[2] ..... B26B 7/00

[58] Field of Search ..... 140/107; 30/106, 124, 30/105, 107, 296 R, 179, 180, 168; 29/200 D, 426

[56] References Cited

UNITED STATES PATENTS

| | | | |
|---|---|---|---|
| 61,499 | 1/1867 | Wright | 30/105 |
| 1,440,264 | 12/1922 | Arn | 30/180 |
| 1,631,495 | 6/1927 | Larc | 30/106 |
| 2,638,667 | 5/1953 | Anderson | 30/107 |
| 2,764,812 | 10/1956 | Thornson | 30/106 |

FOREIGN PATENTS OR APPLICATIONS

| | | | |
|---|---|---|---|
| 1,385,552 | 2/1920 | United Kingdom | 30/106 |

*Primary Examiner*—Al Lawrence Smith
*Assistant Examiner*—J. C. Peters
*Attorney, Agent, or Firm*—Oblon, Fisher, Spivak, McClelland & Maier

[57] ABSTRACT

This invention relates to an apparatus for cutting away rivets of tensioned reinforcements which are protruding beyond the surface of a tension plate used for tensioning the reinforcements in order to increase the strength of a concrete product, characterized in that a chisel, for cutting rivets formed at the end of the tensioned reinforcements, is provided in such a manner that it can slide along the normal line of the tension plate and in contact with the surface of the tension plate, the chisel being interlocked with a fluid-pressure sliding mechanism, and further an immovable part of the mechanism is engaged with a part of the tension plate so that the counter force against the cutting by the chisel is obtained from the tension plate.

3 Claims, 6 Drawing Figures

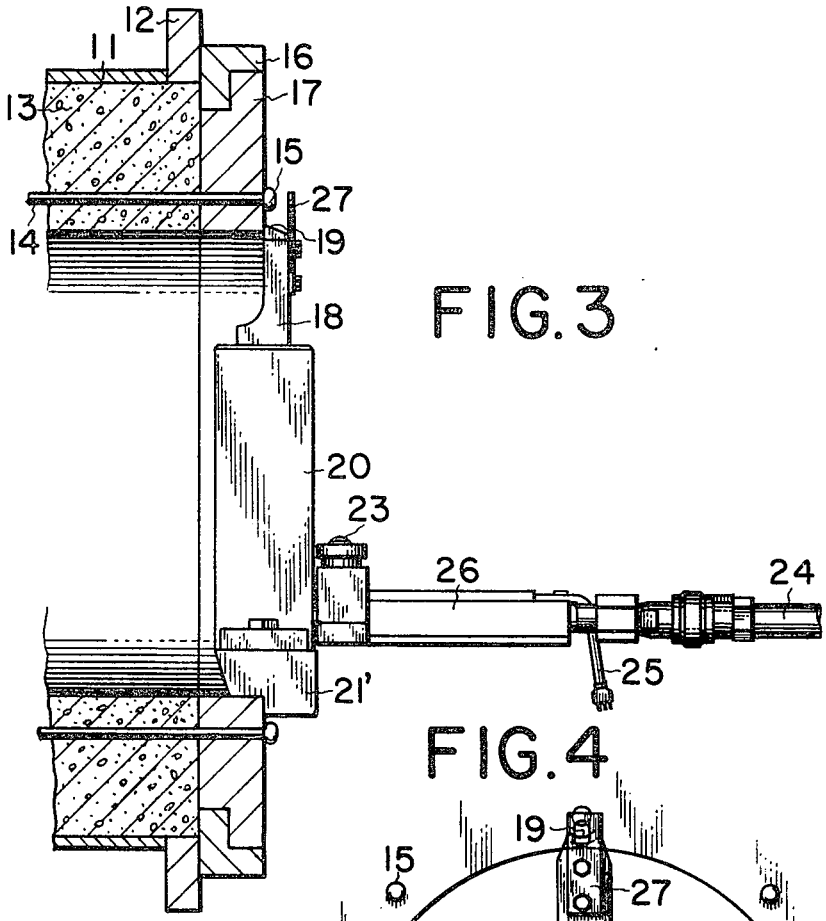
FIG. 3
FIG. 4
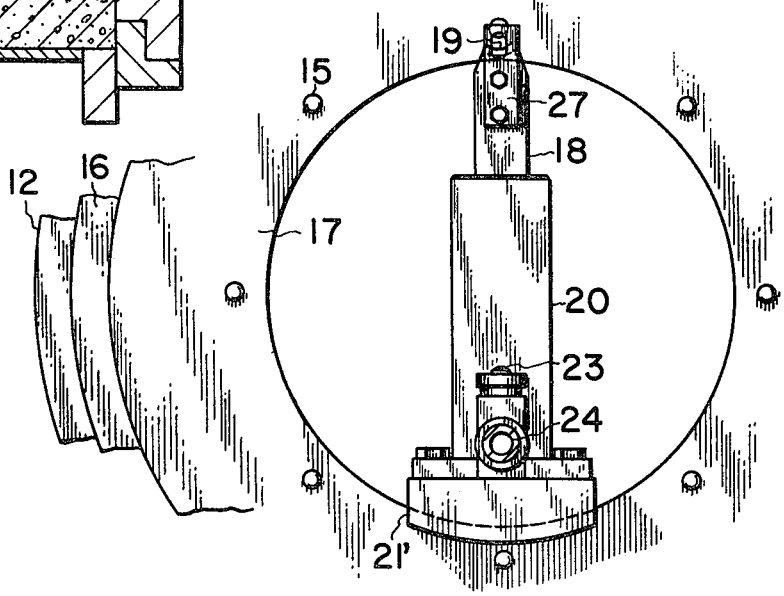

APPARATUS FOR CUTTING RIVETS OF TENSIONED REINFORCEMENT IN THE PROCESS OF MANUFACTURING CONCRETE PRODUCTS

BACKGROUND OF THE INVENTION

This invention relates to an apparatus for cutting away rivets of tensioned reinforcements in the process of manufacturing concrete products of poles, piles and the like.

Generally the strength of a concrete product is increased by imparting tension to the reinforcements inside the concrete product. The tension is provided by making a rivet at the end of each reinforcement, supporting the rivet on the surface of a tension plate and pulling the plate.

Therefore, after the concrete product is finished, the rivet should be cut away in order to remove the plate from the tensioned reinforcements.

Hitherto, rivets have been cut away by fusing with a flame or by hammering a chisel in contact with the rivet, so that there have been many problems such that the working efficiency is low, the cost of equipment is high, skilled technique is required, and the cut rivets sometimes scatter.

Summary of the Invention

The object of the invention is to provide an apparatus by which the above problems can be solved. The feature of the invention is that a chisel, receiving fluid pressure, is used to cut the rivets and the apparatus is small in size, light in weight, low in cost and easy to operate.

Other objects and features of the present invention will be apparent from the following detailed description of the invention.

Brief Description of the Drawings

The accompanying drawings show three examples embodying the present invention;

FIGS. 3 and 4 are respectively a side elevation view and a front elevation view of the second embodiment;

DETAILED DESCRIPTION OF THE ILLUSTRATED EMBODIMENTS

The examples embodying the present invention will be described hereinafter according to the accompanying drawings.

Figure 1:
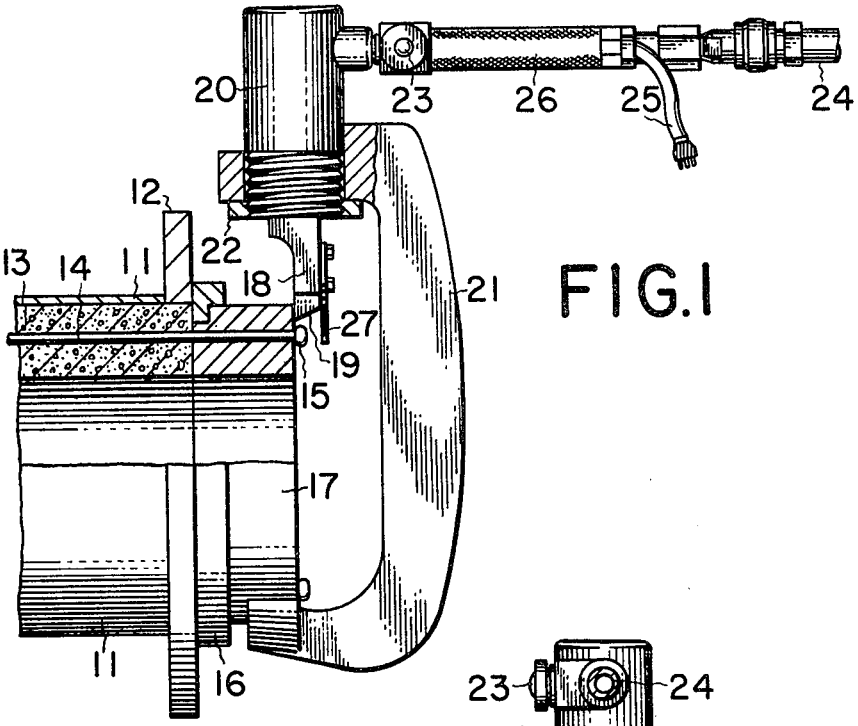
FIGS. 1 and 2 are respectively a side elevation view and a front elevation view of the first embodiment.
Figure 2:
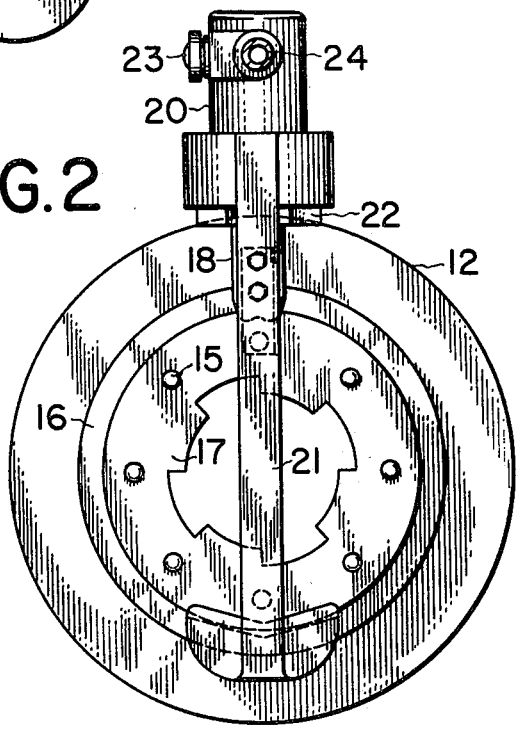

In FIGS. 1 and 2, showing the apparatus of the first embodiment of the present invention, reference numeral 11 designates a mold. An end plate 12 is attached to the end surface of the mold 11 and a concrete pole 13 is disposed inside the mold 11. 14 designates reinforcements disposed inside the concrete pole 13 and rivets 15 are formed respectively at the end of each reinforcement in order to fix the reinforcements at the time of imparting tension to the reinforcements. 17 designates a tension plate attached to the end plate 12 by a setting ring 16. The rivets 15 of the tensioned reinforcements 14 protrude beyond the surface of the plate 17.

18 designates a chisel for cutting the rivets 15 protruding beyond the surface of the tension plate 17 and the chisel 18 has an edge 19 at the forward end to effectively cut the rivets 15. The chisel 18 can be freely adhered closely to the surface of the tension plate 17 and is also freely slidable in the direction of the normal line of the tension plate.

20 designates a fluid pressure mechanism (oil pressure jack) and the forward end of a sliding rod of the oil pressure jack is connected with the base of the chisel 18. Therefore the chisel 18 is driven by the oil pressure jack 20 to cut the rivets 15.

21 designates a counter-force receiving member which is a medium for obtaining the counter force from the tension plate which is required at the time of cutting the rivets 15 by the chisel 18. The member 21 is fixed to the frame of the jack 20 as one body by a lock nut 22. In this embodiment, the counter-force receiving member 21 is longer than the diameter of the tension plate 17 and the forward end of the member 21 engages a part of the outer periphery of the tension plate 17.

23 designates a switch for opening and closing a high-pressure hose 24 which is an oil pressure circuit to operate the oil pressure jack 20. The electricity required for the above operation is supplied from a power cord 25. 26 designates a grip which is used for setting the present apparatus on the surface of the tension plate, 17. 27 is a cover plate, for preventing the cut rivets from scattering, which is fixed on the surface of the chisel 18 so as to protrude beyond the forward end of the chisel 18.

The operation for cutting away the rivets 15 by the use of the present apparatus of the above structure will be explained hereinafter.

First the high-pressure hose 24 and the power cord 25 are connected respectively with the pressure source and the power source. Subsequently, the forward end of the counter-force receiving member 21 is set on a part of the outer periphery of the tension plate 17, and the chisel 18 is adhered closely to the surface of the tension plate 17 in such a manner the edge 19 is placed opposite to the rivet 15 from the outside. Next the switch 23 is turned on to work the jack 20. The jack 20 slides the chisel 18 in the direction of the normal line of the tension plate 17 so that the rivet 15 is cut away. At this time, the counter force can be obtained from a part of the outer periphery of the tension plate 17 which is directly opposite to the position of the chisel 18 through the frame of the jack 20 and the counter-force receiving member 21.

The position of the chisel 18 is adjusted for each rivet and the above operation is repeated to cut away all the rivets. Consequently, the end plate 12, the setting ring 16 and the tension plate 17 can be freely removed.

FIGS. 3 and 4 show the apparatus of the second embodiment of the present invention. Only the method of obtaining the counter force required at the time of cutting the rivets is different from the first embodiment, and the structure and the operation are common to the first embodiment. Namely a counter-force receiving member 21' is in contact with a part of the inner surface of the tension plate 17 which is directly opposite to the position of the chisel 18. Consequently the chisel 18 is slid by the jack 20 outward from the center of the tension plate 17 and the jack 20 is placed within the central portion of the tension plate 17. Accordingly, the present embodiment is suitable mainly for a large diameter concrete pole and the like.

In the above-described two embodiments, one rivet is cut at a time. However it is also possible that more than one set of the jack and the chisel is able to be provided. In that case, a counter-force receiving member should have a shape by which the counter force of each direction can be obtained.

Figure 5:
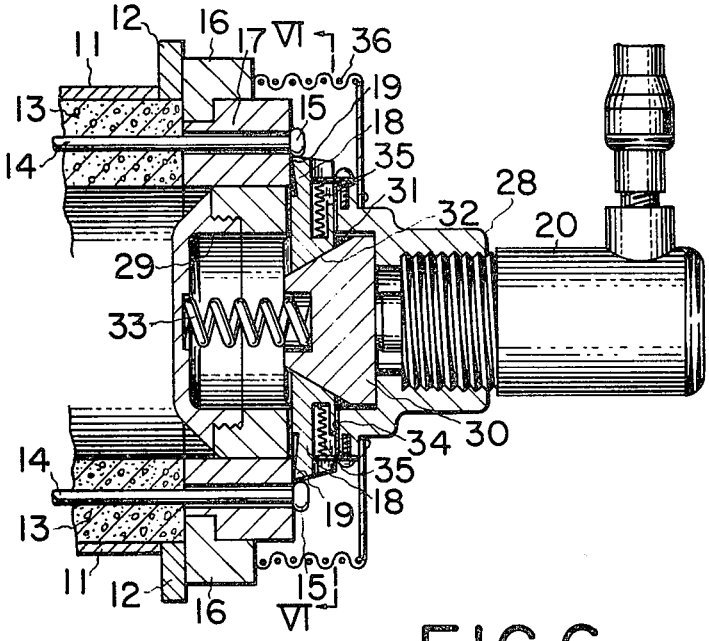
FIG. 5 is a side sectional view of the third embodiment.
Figure 6:
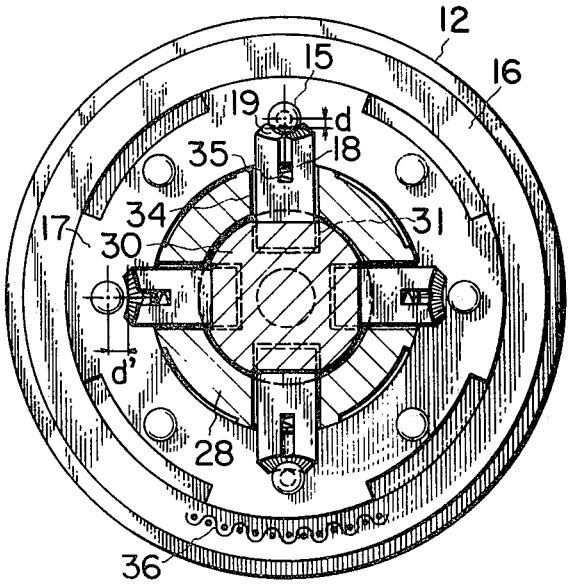
FIG. 6 is a sectional view taken along the line VI—VI of FIG. 5.

FIGS. 5 and 6 show the third embodiment of the present invention. In the apparatus of the present embodiment, a number of rivets protruding beyond the surface of the tension plate can be cut away at a time or by one attaching operation with one jack. In the drawings, the same reference numerals as in FIGS. 1 to 4 show the same parts. 28 designates a main body to be engaged with the central part of the tension plate 17. The outer surface of the main body 28 is in contact with the inner surface of the tension plate 17. The counter force required at the time of cutting rivets 15 with a chisel 18 is obtained from that part. An oil-pressure jack 20 is attached to the central part of the main body 28 by a screw or the like. At the forward part of the jack 20 a guide chamber 29 is formed along the axial line of the tension plate 17.

30 designates a piston which is provided at the forward end of a rod of the jack 20 and disposed in the guide chamber 29. The piston 30 is pushed forward in the chamber 29 by the jack 20 at the time of cutting the rivets 15. Around the outer periphery of the piston 30 there are formed four radial guide grooves 31 along the normal line of the piston 30 and disposed equiangularly thereabout. The bottom of each groove 31 is formed into an inclined plane 32 which is close to the axial core of the piston 30 and which is inclined toward the moving direction of the piston 30. A spring 33 is provided between the piston 30 and the bottom of the guide chamber 29 to push back the piston 30 to the original position after the rivets 15 are cut.

The chisels 18 for cutting the rivets 15 of the tensioned reinforcements 14 are disposed respectively in a freely slidable manner in the four guide grooves 31 and four guide holes 34, which are formed radially at equal intervals within the wall of the main body 28, respectively, and open to a corresponding groove 31. The rear end surface of each chisel 18 is always in contact with the inclined plane 32 of the guide groove 31 in such a manner that the chisel 18 can slide on the plane 32 by means of a spring 35, one end of which is fixed at a part of the main body 28. Moreover, as shown in FIG. 6, the distances $d$ and $d'$ between the edge of each chisel 18 and the axial core of the rivet 15 have a determined suitable difference. Therefore, the time of cutting each rivet 15 is slightly different, so that the force required for the cutting can be decreased.

Reference numeral 36 designates a net attached to the main body 28 surrounding the outside of each chisel 18 and each rivet 15 with the object of preventing the cut rivets 15 from scattering and for collecting them.

The operation of cutting the rivets by the use of the apparatus of the above structure will be explained hereinafter.

First, the main body 28 is disposed within the central hole of the tension plate 17. At the time of cutting the rivets 15, the piston 30 is pushed forward by means of the jack 20, so that the chisels 18, which are always in contact with the inclined planes 32, slide in the guide grooves 31 and the guide holes 34 along the inclined planes 32 and in the direction of the normal line of the tension plate 17 and cut the rivets 15 which are opposite to the edges 19. At this time, the counter force acts on a part of the inner surface of the tension plate 17, which is opposite to the cutting rivet, through the piston 30 and the main body 28. Therefore, the connection of the main body 28 and the tension plate 17 is strengthened, so that there is no anxiety that the main body 28 will slip off the tension plate 17.

In the case that the distances between each chisel 18 and each rivet 15 have a little difference, the cutting of each rivet 15 is done in order, so that the force of the jack 20 to be given to the piston 30 is always required only for cutting one rivet 15 (or two rivets in case two rivets 15 opposite to each other are cut at the same time).

After the rivets 15 opposite to each chisel 18 are cut, the force of the jack 20 imparted to the piston 30 is removed, and thereby the piston 30 is pushed back to the original position by the pressure of the spring 33. All the while, each chisel 18 is maintained in contact with the inclined plane 32 by the spring 35.

Each cut rivet 15 is prevented from scattering by the net 36 and is collected within the net 36.

Thereafter, the main body 28 is turned to place each chisel 18 at a position opposite to the next cutting rivet 15 and the above operation is repeated.

As abovedescribed, according to the present invention, after a concrete product is completed, rivets of tensioned reinforcements can be automatically and rapidly cut. Therefore, labor can be reduced, and the present apparatus is extremely effective and causes no risk, as compared with the case by men, and is superior in the cost of equipment, safety and treatment, as compared with the case by gas or arc.

If the apparatus is constructed so as to be freely removable from a tension plate, it can be used easily for other things. The construction is also possible by which a number of rivets can be cut away at one operation, and thereby the efficiency can be improved. In that case, if the time of cutting by each chisel is a little different, large forces are not required for the cutting and thereby the apparatus can be made small.

We claim:

1. Apparatus for cutting rivets, formed upon the ends of tensioned reinforcements, which protrude beyond the surface of an annular tension plate used for tensioning said reinforcements in order to increase the strength of a concrete product, comprising:

a main body co-axially aligned with said tension plate and having one end thereof disposed interiorly of said tension plate, the diameter of said body being substantially the same as, or slightly less than, that of said tension plate whereby said body is in peripheral contact with the inner surface of said tension plate so as to stabilize said main body, with respect to said tension plate and said concrete product, when said apparatus cuts said rivets;

a plurality of radially extending chisel means slidably disposed, within said main body and along the outer radially disposed end surface of said tension plate for simultaneously engaging and cutting said rivets, the radially inner ends of said chisel means having inclined surfaces;

an oil pressure jack operatively connected to the other end of said main body;

a piston slidably disposed within said main body and operable by means of said oil pressure of said jack;

said piston having a substantially frusto-conical configuration so as to include a substantially conical peripheral surface which simultaneously operatively engages said inclined surfaces of said chisel means;

axially disposed spring means interposed between said one end of said main body and said piston for biasing said piston against the oil pressure of said jack; and radially disposed spring means interposed between said main body and said chisel means for biasing said chisel means against the inclined peripheral surface of said piston means.

2. Apparatus as set forth in claim 1, further comprising:

flexible cover means secured to said main body and said tension plate for covering said tension plate so as to prevent scatter of said rivets after said rivets have been cut by said chisel means.

3. Apparatus as set forth in claim 1, wherein:

said chisel means comprises four chisels equiangularly disposed about the periphery of said main body.

* * * * *